US010010206B1

(12) United States Patent
Schuff

(10) Patent No.: US 10,010,206 B1
(45) Date of Patent: Jul. 3, 2018

(54) HANGER ORGANIZER

(71) Applicant: David A Schuff, Surprise, AZ (US)

(72) Inventor: David A Schuff, Surprise, AZ (US)

( * ) Notice: Subject to any disclaimer, the term of this patent is extended or adjusted under 35 U.S.C. 154(b) by 0 days.

(21) Appl. No.: 15/633,728

(22) Filed: Jun. 26, 2017

(51) Int. Cl.
*A47G 25/14* (2006.01)
*A47G 29/08* (2006.01)

(52) U.S. Cl.
CPC ..... *A47G 25/1464* (2013.01); *A47G 29/083* (2013.01)

(58) Field of Classification Search
CPC ..... A47G 25/1464; A47G 29/083
See application file for complete search history.

(56) References Cited

U.S. PATENT DOCUMENTS 2,113,394 A 12/1936 Biri et al.
2,791,335 A 4/1952 Leebow
3,270,892 A 9/1966 Dennis et al.
3,519,139 A 7/1970 Brennan
4,037,728 A 7/1977 Cameron
4,266,705 A * 5/1981 Wheeler ..... A47G 25/1457 294/143
4,632,286 A 12/1986 Koyama
4,730,737 A 3/1988 Robinson
5,188,241 A * 2/1993 Kobza ..... A47G 25/1464 211/113
5,480,075 A 1/1996 Robinson
5,613,628 A 3/1997 Burkhalter
5,810,216 A 9/1998 Leopold
5,924,578 A * 7/1999 McKenzie ..... A47G 25/1464 211/106
6,758,378 B2 * 7/2004 Carmichael ..... A47G 25/16 223/85
6,808,078 B2 10/2004 Ta
7,404,502 B2 7/2008 Ho et al.
7,469,805 B2 12/2008 Lynch
7,628,302 B2 12/2009 Yau
7,793,808 B1 9/2010 Herman et al.
8,292,134 B2 10/2012 Lin
8,870,145 B1 10/2014 Carlson et al.
8,985,408 B2 3/2015 Lloyd et al.
9,290,133 B1 * 3/2016 Bishop ..... B60R 11/00
9,326,629 B2 * 5/2016 Elstein ..... A47G 25/005
2002/0038788 A1 4/2002 Halleman et al.
2005/0224531 A1 * 10/2005 Bulovic ..... A47G 25/0657 223/85
2012/0080459 A1 * 4/2012 Dy ..... A47G 25/10 223/91

(Continued)

*Primary Examiner* — Ko H Chan
(74) *Attorney, Agent, or Firm* — Invention To Patent Services; Alex Hobson

(57) ABSTRACT

A hanger organizer has a hanger portion with a rod hook that suspends the hanger organizer from a closest rod. An extension from the rod hook extends to a coupler portion from which a first and second hanger retainer arm extends. The first and second hanger retainer arms extend in opposing direction and have a bend that leads to the arms for retaining the hanger loop ends. A hanger hook retainer which may be a receptacle extends out perpendicularly to the vertical axis of the hanger organizer for hooking a clothes hanger there around. A plurality of ties may be placed in the receptacle and used to synch around a plurality of hangers for return to the dry-cleaners.

19 Claims, 4 Drawing Sheets

(56) References Cited

U.S. PATENT DOCUMENTS

| | | | | |
|---|---|---|---|---|
| 2013/0240576 | A1* | 9/2013 | King | A47G 25/28<br>223/85 |
| 2014/0048670 | A1* | 2/2014 | Harris | F16M 11/00<br>248/346.03 |
| 2016/0223137 | A1* | 8/2016 | Ochipa | B67B 7/16 |
| 2017/0273489 | A1* | 9/2017 | Karelis | A47G 25/28 |

* cited by examiner

HANGER ORGANIZER

BACKGROUND OF THE INVENTION

Field of the Invention

The invention is directed to a hanger organizer for retaining a plurality of clothes hangers and a receptacle attached thereto for retaining ties to couple said plurality of hangers together.

Background

Many people return the clothes hangers to the dry cleaners along with their cloths in a dry-cleaning bag. The hangers can be difficult to retain together and the hook ends can damage clothes and upholstery. Those that do not return the hangers to the dry cleaners end up with a large number of cheap metal hangers in their closet that take up valuable closet rod space.

SUMMARY OF THE INVENTION

The invention is directed to a hanger organizer comprising a hanger portion that has a rod hook for placement over a rod, such as a clothes rod in a closet and a hanger retainer portion, that is configured to retain clothes hangers thereon. The hanger retainer portion comprises a first hanger retainer arm and second hanger retainer arm that extend out in opposing directions to retain a plurality of hangers by the hanger loops, the opposing extended loop ends of the hanger. The hook portion of the clothes hanger extends around a hanger hook retainer that may be a receptacle for retaining ties for coupling the plurality of clothes hangers together. The first hanger retainer arm and second hanger retainer arm extend in opposing direction and may be detachably attachable to a coupler portion. A collar may be configured to slide along the receptacle to further retain the plurality of clothes hangers on the hanger hook retainer of the hanger organizer.

An exemplary hanger portion of the hanger organizer has a rod hook that extends over a rod, such as a clothes rod in a closet. A hanger extension extends down from the rod hook to a coupler portion. The first and second hanger retainer arms extend out from the coupler portion in opposing directions. The hanger extension may have a length from the top of the rod hook to the extended end or coupler portion that is at least about 100 mm, or about 150 m or more, or about 200 mm or more. The hanger extension may be suitably long to enable the hanger retainer portion to be displaced from the clothes rod, thereby freeing space along the clothes rod for other clothes hangers and clothing thereon.

The first and second hanger retainer arms extend down from an attached end, attached to the coupler portion, to a bend, wherein the hanger retainer arm bend and extends out to produce an arm for placement of clothes hangers. The first and second arms may extend out substantially perpendicular from the extension portion. The spacing of the first and second arms from each other may be configured to enable the hanger loop portion of a clothes hanger to fit there over, wherein a first hanger end extends around the first arm and a second hanger end extends around the second arm. The first and second arms may have a length from the bend to the extended end that is about 50 mm or more, about 75 mm or more, about 100 mm or more and any range between and including the lengths provided. The length may be suitable for retaining a plurality of hanger hooks thereon. The hook portion of the clothes hanger is retained around a hanger hook retainer, which may be a receptacle for holding a plurality of ties, such as cable ties, hose ties, steggel ties, zap strap or zip-ties, or alternatively flexible twist ties, that can be used to couple a plurality of clothes hangers. A cable tie has an aperture on one end for receiving the opposing extended end therein; the extended end can be pulled through the aperture to reduce the size the loop formed by the tie. An exemplary receptacle may comprise a collar that extends around the outer surface of the receptacle and is slidably engaged, to allow the clothes hanger hooks to be squeezed and retainer on the receptacle. A receptacle may have a collar track that retains the collar in a location along the length of the retainer or receptacle. A release mechanism, such as a lever may be used to release the collar and allow it to slide along the length of the retainer or receptacle. An exemplary receptacle is a cylinder shape having a circular cross-section and a central cavity. A cap may be configured to fit over the receptacle opening to prevent ties retained therein from spilling out.

An exemplary hanger hook retainer, or receptacle, may be coupled to the coupler portion and extend out substantially parallel with the first and second arms, thereby producing a three-arm retainer arrangement for the clothes hangers, with the hanger hook of the clothes hanger extending over the hanger hook retainer, or receptacle, and the first and second hanger loops, extending around the first and second arms, respectively. An exemplary receptacle has a cavity for retaining ties and may comprise a cap for closing off an opening to the receptacle to prevent ties from falling out.

An exemplary hanger organizer may further comprise an accessory portion for retaining an accessory, such as a purse or bag therefrom. The accessory portion may extend down from the coupler portion to an accessory arm bend and an accessory arm may extend out from the accessory arm bend. The accessory arm extension portion may extend down along a vertical axis of the hanger organizer and be aligned with the hanger extension. The weight of an accessory attached to the accessory arm may be centered between first and second arms and substantially centered under a rod from which the hanger organizer is suspended. The accessory arm may extend substantially parallel with the first and second arms. The handle or strap of an accessory may be placed over the accessory arm to retain or hang the accessory therefrom. The length of the accessory arm may be less than the lengths of the first and second arms and may be 15 mm or more, about 25 mm or more, about 50 mm or more, about 100 mm or more and any range between and including the lengths provided. A long accessory arm may allow a plurality of accessories to be hung therefrom.

A coupler portion is where the hanger extension and the first and second hanger are attached and it may be the hanger hook retainer, or receptacle.

An exemplary hanger organizer may be made out of plastic, such as polyethylene, polymethyl methacrylate, acrylic, and the like, or metal, such as aluminum or steel.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of his specification, illustrate embodiments of the invention, and together with the description serve to explain the principles of the invention.

Figure 1:
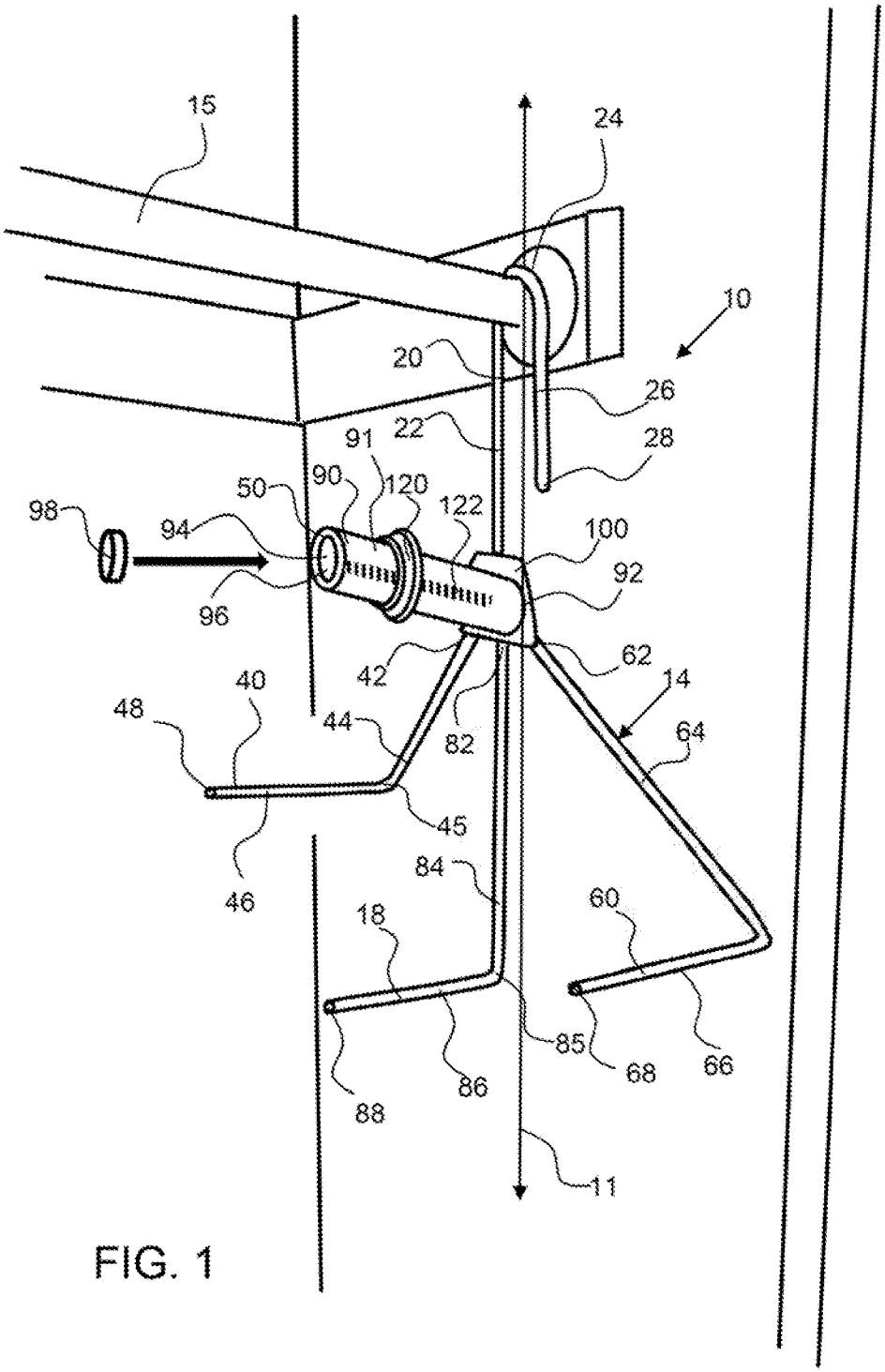
FIG. 1 shows an exemplary hanger organizer hanging from a closet and having a hanger portion, a hanger retainer portion, a receptacle for ties and an accessory portion.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Substantially parallel, as used herein, is within about 30 degrees of each other and more preferably within about 20 degrees of each other and even more preferably within about 10 degrees of each other.

Substantially perpendicular to each other, as used herein, is within about 30 degrees of perpendicular, more preferably within about 20 degrees of perpendicular and even more preferably within about 10 degrees of perpendicular.

Figure 2:
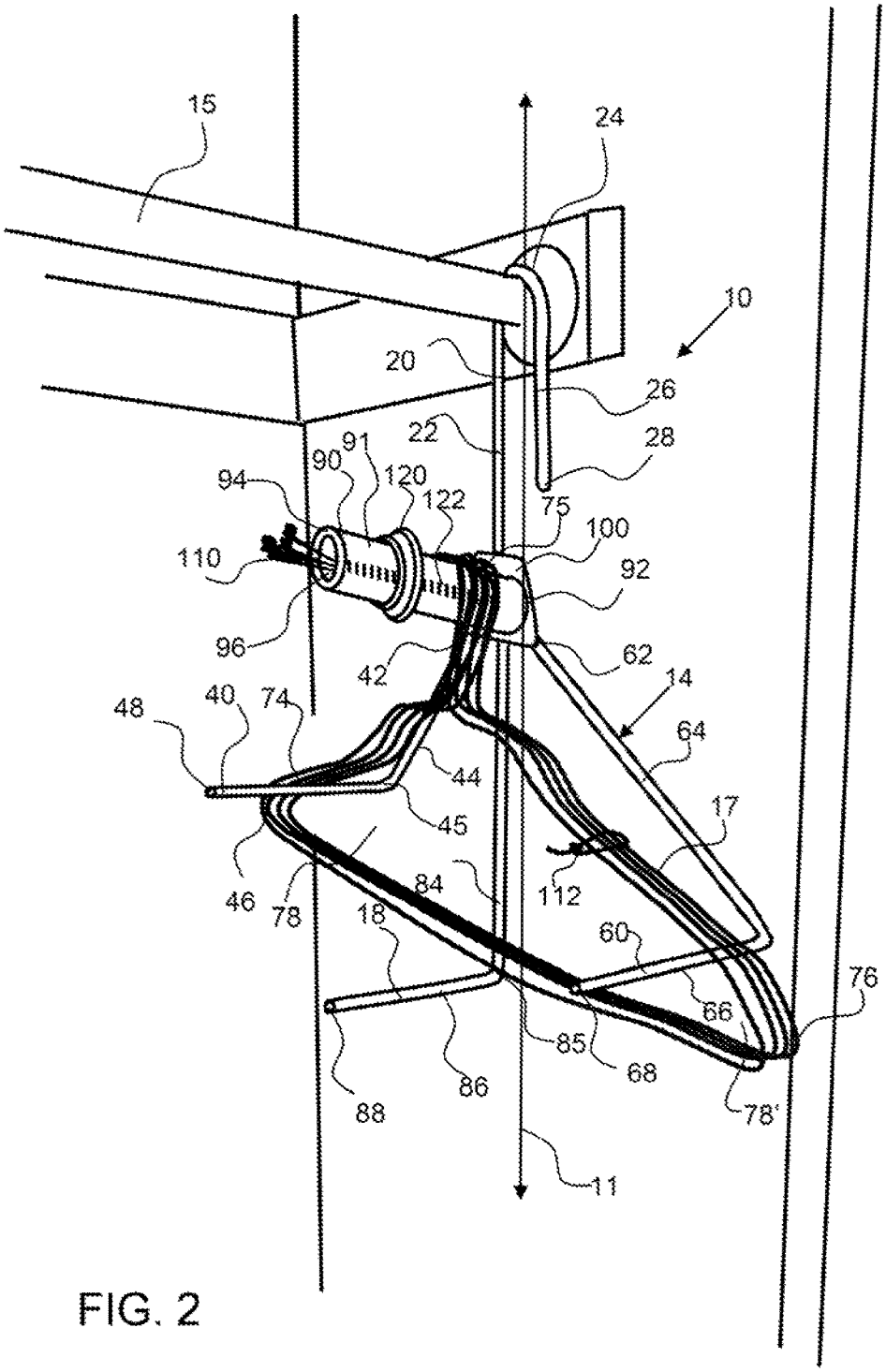
FIG. 2 shows the hanger organizer shown in FIG. 1, with a plurality of clothes hangers retained by the hanger retainer portion and a plurality of ties in the receptacle.
Figure 3:
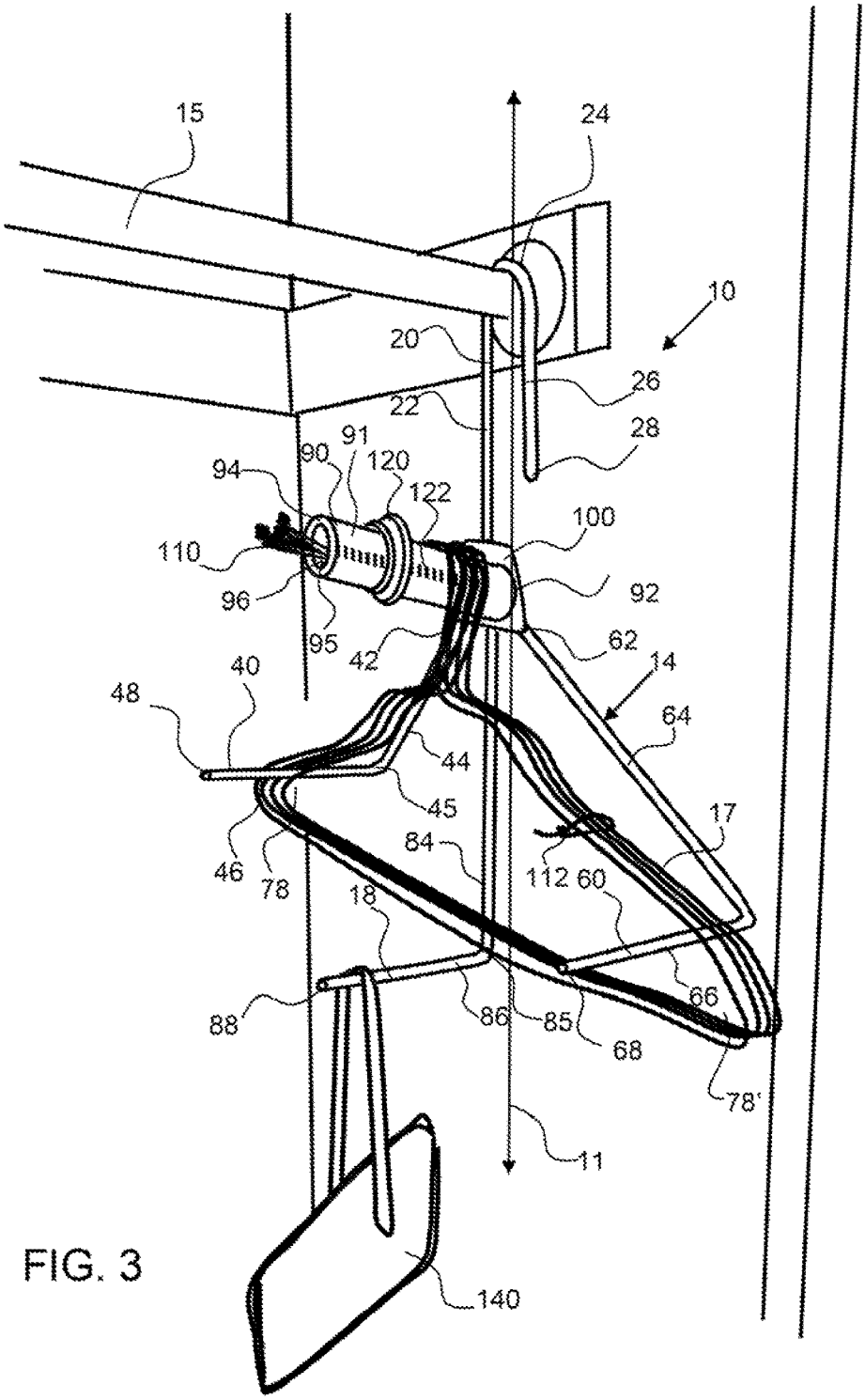
FIG. 3 shows the hanger organizer shown in FIG. 2, with a purse hanging from the accessory arm.

Referring now to FIGS. 1 to 3, an exemplary hanger organizer 10 is hanging from a closet rod 15 and has a hanger portion 20, a hanger hook retainer 91 that is a receptacle 90 for ties 110, an accessory portion 18 and a hanger retainer portion 14. The hanger retainer portion comprises a first hanger retainer arm 40 and a second hanger retainer are 60 that extend out from the coupler portion 100 in opposing direction. The hanger portion 20 comprises a hanger extension 22 that extends from a rod hook 24 to the coupler portion 100. A rod hook extension 26 extends back down from the rod hook 24 to an extended end 28. The hanger portion allows the hanger organizer 10 to be hung from a closest rod 15, as shown.

The receptacle 90 is coupled with the coupler portion 100 and extends out substantially perpendicularly to the vertical axis 11 when the hanger organizer is hanging from a support. The receptacle has a length from an attached end 92 to an extended end 94. An opening 96 is configured in the extended end to receive ties 110 for retaining a plurality of hangers 17 together, as shown in FIG. 2. The twist ties, or cable ties, also known as hose ties, steggel ties, or zip ties having an opening on one end for receiving the opposing extended end of the tie that is pulled through to form a loop. A collar 120 extends over the receptacle and is retained on the receptacle by a collar track 122. The collar may be manipulated to slide and engage with the collar track to retain the collar in a fixed location along the length of the receptacle. For example, the collar may have a release button or lever to disengage the collar from the track to allow it to easily slide along the receptacle. The collar retains the hook portion of a plurality of hangers on the receptacle. As shown, the hanger hook retainer 91 or receptacle 90 is a cylinder having an opening 96 on the extended end 96 to the cavity 95.

The hanger retainer portion 14 has a first hanger retainer arm 40 and a second hanger retainer arm 60 that extend from coupler portion 100 in opposing directions. The first hanger retainer arm has an attached end 42, an extension portion 44 that has a length from the attached end to a first arm bend 45. The extension portion extends downward at an offset angle, which is about 45 degrees to the vertical axis, to the first arm bend and then the first hanger retainer portion extends from the bend to the first arm 46, which extends substantially perpendicularly to the length axis 11 and the extension portion. The first arm bend is about a 90 degree bend. The first arm has a length from the first arm bend 45 to the extended end 48.

The second hanger retainer arm 60 extends from coupler portion 100 in an opposing direction to the first hanger retainer arm 40. The second hanger retainer arm has an attached end 62, an extension portion 64 that has a length from the attached end to a second arm bend 65. The extension portion extends downward at an offset angle, which is about 45 degrees to the vertical axis, to the second arm bend and then the second hanger retainer portion extends from the bend to the second arm 66, which extends substantially perpendicularly to the length axis 11 or the extension portion of the second hanger retainer arm. The second arm bend is about a 90 degree bend. The second arm has a length from the second arm bend 65 to the extended end 68.

Hangers 17 are retained on the hanger retainer portion with the hook portion of the hanger 75 extending over the hanger hook retainer 91, or the receptacle 90 and the first hanger end 74 extending around the first arm 46 of the hanger retainer portion 14 and the second hanger end 76 extending around the second arm 66 of the hanger retainer portion. The collar 120 may be slid down over the hanger hook retainer 91 or receptacle 90 to prevent the hangers 17 from sliding off of the hanger organizer 10. When a plurality of hangers are collected on the hanger organizer 10, a tie 110 may be retrieved from the cavity 95 of the receptacle 90 and configured around the hangers 17 to form a looped tie 112 around the hangers 17, as shown in FIGS. 2 and 3. A cap 98 may close the opening 96 of the cavity to prevent the ties from falling out of the receptacle 90.

An extension portion 84 of an exemplary accessory portion 18 extends down from the coupler portion 100 and has an accessory arm bend 85, from which the accessory arm 86 extends substantially perpendicularly to the length axis 11. The accessory arm 86 has a length from the accessory arm bend to the extended end 88. The accessory arm, the first arm and the second arm may all extend substantially parallel to each other. An accessory 140, such as a purse may be hung from the accessory arm 86 as shown in FIG. 3.

Figure 4:
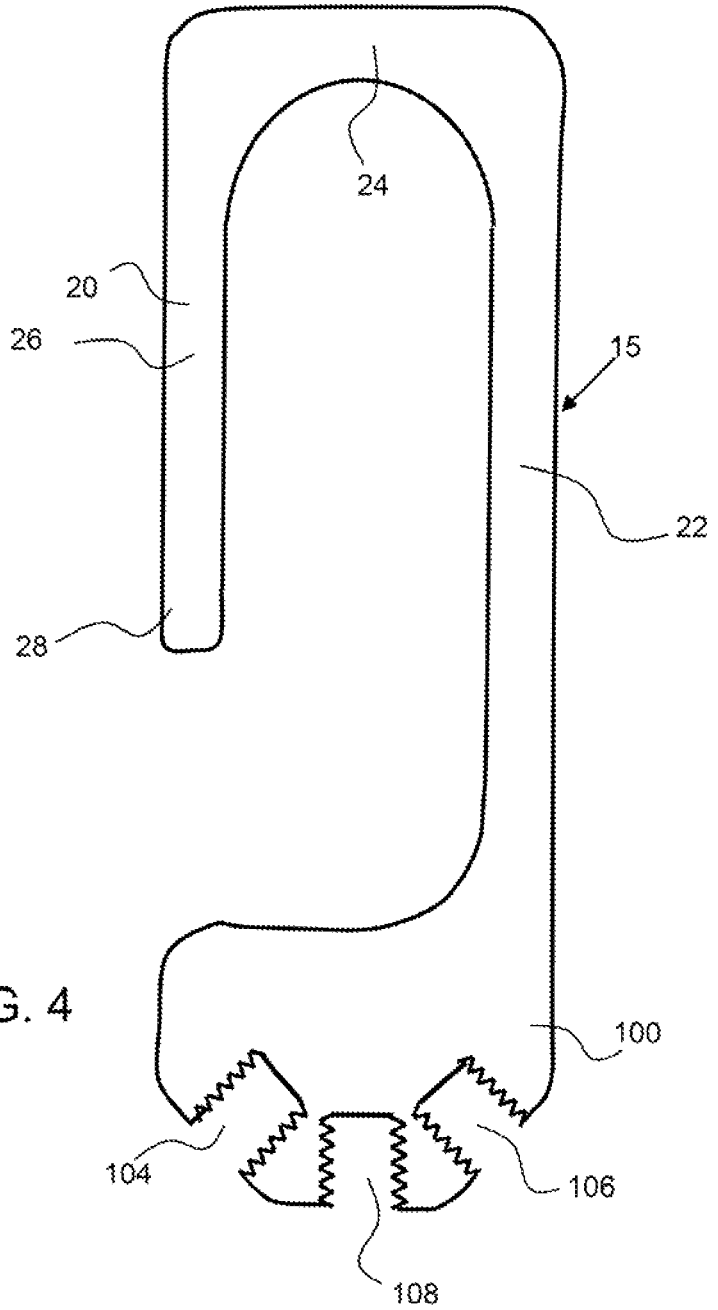
FIG. 4 shows a side view of an exemplary hanger portion having attachment features for the first and second retainer arms, and the accessory portion.
Figure 5:
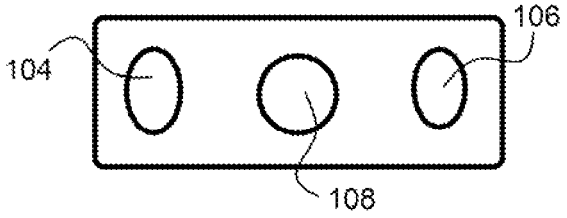
FIG. 5 shows an end view of an exemplary hanger portion having attachment features for the first and second retainer arms, and the accessory portion.

As shown in FIGS. 4 and 5, an exemplary hanger portion 20 has a hanger extension 22 that extends down from the rod hook 24 to the coupler portion 100. A rod hook extension 26 extends down from the rod hook 24 to an extended end 28. The coupler portion has a first arm attachment feature 104, a second arm attachment feature 106 and an accessory attachment feature 108. The attachment features are threaded apertures for screwing in the respective features. The attached end 42 of the first hanger retainer arm 40, the attached end 62 of the second hanger retainer arm 60 and the attached end 82 of the accessory portion 18, as shown in FIG. 1, may have threaded ends for detachable attachment to the coupler portion.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A hanger organizer comprising:

a) a hanger portion comprising:
- i) hanger extension; and
- ii) a rod hook;
- wherein the rod hook is configured to extend around a rod to hang the hanger organizer from said rod and wherein the hanger extension extends from the rod hook to an extended end;

b) a coupler portion attached to the extended end of the hanger extension;

c) a first hanger retainer arm extending from the coupler portion and comprising:
- i) a first attached end attached to the coupler portion;
- ii) a first extension portion extending down from the coupler portion;
- iii) a first arm bend;
- iv) a first arm;
- v) a first extended end;
- vi) a first arm length from the first arm bend to the first extended end;
- wherein the first arm extends substantially perpendicularly to the first extension portion;

d) a second hanger retainer arm extending from the coupler portion and comprising:
- i) a second attached end attached to the coupler portion;
- ii) a second extension portion extending down from the coupler portion;
- iii) a second arm bend:
- iv) a second arm;
- v) a second extended end;
- vi) a second arm length from the second arm bend to the second extended end;
- wherein the second arm extends substantially perpendicularly to the second extension portion; and
- wherein the first extension portion and second extension portion extend in opposing directions from the coupler portion;

e) a hanger hook retainer comprising:
- i) an attached end that is attached to the hanger organizer;
- ii) an extended end;
- iii) a length from the attached end to the extended end;
- wherein the hanger organizer is configured to retain a plurality of clothes hangers with a hook portion of the clothes hanger extending over the hanger hook retainer and a first hanger end extending around the first arm and a second hanger end extending around the second arm.

2. The hanger organizer of claim 1, further comprising an opening of a cavity in the extended end of the hanger hook retainer, wherein the hanger hook retainer is a receptacle for a plurality of ties.

3. The hanger organizer of claim 2, further comprising a cap that is detachably attachable to the opening to the cavity.

4. The hanger organizer of claim 1, further comprising a rod hook extension that extend down from the rod hook and is substantially parallel with the hanger extension.

5. The hanger organizer of claim 1, wherein the hanger extension has a length from the top of the rod hook to the extended end that is at least 75 mm.

6. The hanger organizer of claim 1, wherein the first am and the second arm extend substantially, parallel to each other.

7. The hanger organizer of claim 1, wherein the length of the first arm and the length of the second arm are at least 75 mm.

8. The hanger organizer of claim 1, wherein the hanger hook retainer extends substantially parallel with the first and second arms.

9. The hanger organizer of claim 1, wherein the attached end of the hanger hook retainer is attached to the coupler portion.

10. The hanger organizer of claim 1, wherein the hanger hook retainer is a cylinder having a circular cross-section.

11. The hanger organizer of claim 2, further comprising a collar that extend over the hanger hook retainer and is slidably engaged with the receptacle.

12. The hanger organizer of claim 11, further comprising a collar track for retaining the collar in a location along a portion of the length of the receptacle.

13. The hanger organizer of claim 1, comprising an accessory portion comprising:
- i) an accessory attached end attached to the coupler portion;
- ii) an accessory extension portion extending down from the coupler portion;
- iii) an accessory bend;
- iv) an accessory arm;
- v) an accessory extended end;
- vi) an accessory length from the accessory bend to the accessory extended end;
- wherein the accessory arm extends substantially perpendicularly to the accessory extension portion.

14. The hanger organizer of claim 13, wherein the accessory arm extends substantially parallel with the first arm and the second arm.

15. The hanger organizer of claim 13, wherein the accessory h is at least 25 mm.

16. The hanger organizer of claim 1, wherein the first hanger retainer arm and the second hanger retainer arm are detachably attachable to the coupler portion.

17. The hanger organizer of claim 16, wherein the first attached end of the first hanger retainer arm and the second attached end of the second hanger retainer arm are threaded and wherein the coupler portion comprises a first threaded hole and a second threaded hole for detachably attaching the first and second hanger retainer arms, respectively.

18. The hanger organizer of claim 1, consisting essentially of plastic.

19. A hanger organizer comprising:

a) a hanger portion comprising:
- i) hanger extension; and
- ii) a rod hook;
- wherein the rod hook is configured to extend around a rod to hang the hanger organizer from said rod and wherein the hanger extension extends from the rod hook to an extended end;

b) a coupler portion attached to the extended end of the hanger extension;

c) a first hanger retainer arm extending from the coupler portion and comprising:
- i) a first attached end attached to the coupler portion;
- ii) a first extension portion extending down from the coupler portion;
- iii) a first arm bend;
- iv) a first arm;
- v) a first extended end;
- vi) a first arm length from the first arm bend to the first extended end;
- wherein the first arm extends substantially perpendicularly to the first extension portion;

d) a second hanger retainer arm extending from the coupler portion and comprising:
- i) a second attached end attached to the coupler portion;
- ii) a second extension portion extending down from the coupler portion;
- iii) a second arm bend;
- iv) a second arm;
- v) a second extended end;
- vi) a second arm length from the second arm bend to the second extended end;
- wherein the second arm extends substantially perpendicularly to the second extension portion; and
- wherein the first extension portion and second extension portion extend in opposing directions from the coupler portion;

e) a receptacle comprising:
- i) an attached end that is attached to the hanger organizer;
- iii an extended, end having an opening to a cavity for retaining a plurality of ties;
- iii) a length from the attached end to the extended end;
- wherein the hanger organizer is configured to retain a plurality of clothes hangers with a hook portion of the clothes hanger extending over the receptacle and a first hanger end extending around the first arm and, a second hanger end extending around the second arm.

* * * * *